US010703541B2

(12) United States Patent
Hosokawa et al.

(10) Patent No.: US 10,703,541 B2
(45) Date of Patent: Jul. 7, 2020

(54) MEDIUM STORAGE BOX AND MEDIUM PROCESSING DEVICE

(71) Applicant: Oki Electric Industry Co., Ltd., Tokyo (JP)

(72) Inventors: Kazuhiro Hosokawa, Tokyo (JP); Shuuichi Hiratsuka, Tokyo (JP); Wataru Wakushima, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 16/473,842

(22) PCT Filed: Dec. 21, 2017

(86) PCT No.: PCT/JP2017/046034
§ 371 (c)(1),
(2) Date: Jun. 26, 2019

(87) PCT Pub. No.: WO2018/198433
PCT Pub. Date: Nov. 1, 2018

(65) Prior Publication Data

US 2019/0337676 A1 Nov. 7, 2019

(30) Foreign Application Priority Data

Apr. 28, 2017 (JP) ..... 2017-090512

(51) Int. Cl.
*B65D 25/28* (2006.01)
*G07D 11/12* (2019.01)
*G07D 9/00* (2006.01)

(52) U.S. Cl.
CPC ..... *B65D 25/28* (2013.01); *G07D 9/00* (2013.01); *G07D 11/12* (2019.01); *B65D 2525/283* (2013.01); *B65D 2525/288* (2013.01)

(58) Field of Classification Search
CPC .... B65D 25/28; B65D 25/2867; B65D 25/32; B65D 2525/283; B65D 2525/288;
(Continued)

(56) References Cited

U.S. PATENT DOCUMENTS 2,773,640 A * 12/1956 Wheelbarger et al. ... G07F 9/06 232/16
3,292,849 A * 12/1966 Ewing ..... E05G 1/005 232/43.2

(Continued)

FOREIGN PATENT DOCUMENTS

JP 02012592 A 1/1990
JP 2006235988 A 9/2006

(Continued)

*Primary Examiner* — William L Miller
(74) *Attorney, Agent, or Firm* — Rabin & Berdo, P.C.

(57) ABSTRACT

A medium storage box includes a storage unit that stores a medium, a handle configured to rotate in a first direction from a first state to a second state and a second direction opposite to the first direction from the second state to the first state, and a rotation restricting portion that prevents rotation of the handle in the second direction. The handle includes a grip portion and an arm that includes an upper surface portion or a top portion and extends in an extending direction toward the upper surface portion or the top portion from the rotational axis. The arm is configured such that an end portion of an arm center line side in the upper surface portion or the top portion is separated toward a first direction side with respect to an arm center line extending from the rotational axis to the extending direction.

9 Claims, 11 Drawing Sheets

(58) Field of Classification Search
CPC .. G07D 11/12; G07D 11/125; G07D 11/0096; G07D 9/00; G07F 9/06; G07F 19/201; G07F 19/202; Y10T 16/4567; Y10T 16/464; Y10T 16/4554; Y10T 16/473; Y10T 16/515; A45C 13/26
USPC ..... 232/1 D, 15, 16, 43.2; 194/350; 902/9; 16/408, 419, 405, 429, 445; 220/756, 220/761–763; 190/115, 39
See application file for complete search history.

(56) References Cited

U.S. PATENT DOCUMENTS 3,321,130 A * 5/1967 Cleghorn ..... B65F 1/06 232/43.2
3,841,550 A * 10/1974 Kaneda ..... G07F 9/06 232/15
3,948,376 A * 4/1976 Roman ..... G07F 9/06 194/317
4,066,155 A * 1/1978 Buchek ..... A45C 5/00 190/115
4,529,118 A * 7/1985 Granzow ..... E05G 5/006 232/43.3
4,638,746 A * 1/1987 Ishigure ..... G07D 11/125 109/52
5,009,365 A * 4/1991 Holtzer ..... G07F 9/06 232/16
6,389,645 B1 * 5/2002 Polidoro ..... A45C 13/26 16/405
6,843,409 B2 * 1/2005 Park ..... G07D 11/125 232/1 D
8,640,913 B2 * 2/2014 Berendes ..... A45C 13/26 16/409
2009/0272621 A1 * 11/2009 Braukmann ..... G07D 9/00 194/350

FOREIGN PATENT DOCUMENTS

JP 2010211340 A 9/2010
JP 2012048313 A 3/2012

* cited by examiner (STANDING STATE)

(LYING STATE)

(COMPARATIVE EXAMPLE)

MODIFICATION EXAMPLE 3

MEDIUM STORAGE BOX AND MEDIUM PROCESSING DEVICE

TECHNICAL FIELD

The present disclosure relates to a medium storage box for storing a medium and a medium processing device loaded with such medium storage box.

BACKGROUND ART

For example, a medium processing device such as a banknote pay-in/pay-out device to perform various transactions related to a medium, such as a banknote, is widely employed (see, for example, Japanese Patent Application Laid-Open (JP-A) No. H02-012592, Japanese Patent Application Laid-Open (JP-A) No. 2012-48313, and Japanese Patent Application Laid-Open (JP-A) No. 2010-211340).

Generally, the medium processing device is configured such that a medium storage box for internally storing such a medium is attachable to and detachable from the main body of the medium processing device.

SUMMARY OF THE INVENTION

Technical Problem

Generally, it is desired to improve reliability of the medium storage box in such the medium processing device. To do so, it is desirable to provide the medium storage box and the medium processing device capable of improving reliability.

Solution to Problem

A medium storage box according to an exemplary embodiment of the present disclosure, includes a storage unit that stores a medium, a handle configured to rotate with respect to the storage unit around an axis of rotation (hereinafter "rotational axis,") between a first state standing with respect to the storage unit and a second state lying with respect to the storage unit, and a rotation restricting portion. The rotation restricting portion restricts rotation of the handle from the first state to the second state in a first direction, and from the second state to the first state in a second direction that is opposite to the first direction. The handle includes a grip portion and an arm. The grip portion extends in a parallel direction of the rotational axis.

The arm includes an upper surface portion or a top portion on the grip portion side and extends in an extending direction from the rotational axis toward the upper surface portion or top portion. The arm is configured such that an end portion of an arm center line side in the upper surface portion or top portion is separated toward the first direction side with respect to an arm center line extending from the rotational axis to the extending direction.

A medium processing device, includes a main body, and a medium storage box that is attachable to and detachable from the main body. The medium storage box includes a storage unit that stores a medium, a handle configured to rotate with respect to the storage unit around a rotational axis between a first state standing with respect to the storage unit and a second state lying with respect to the storage unit, and a rotation restricting portion. The rotation restricting portion restricts (prevents) rotation of the handle in the second direction when the handle is in the first state, while permitting the handle to rotate in the first direction from the first state to the second state. Similarly, when the handle is in the second state, the rotation restricting portion permits the handle to rotate in the second direction to the first state, while preventing the handle to rotate past the first (standing) state in the second direction. The handle includes a grip portion that extends in a parallel direction of the rotational axis, and an arm that includes an upper surface portion or a top portion and extends from the rotational axis in an extending direction toward the upper surface portion or the top portion. The arm is configured such that an end portion of an arm center line side in the upper surface portion or the top portion is separated toward the first direction side with respect to an arm center line extending from the rotational axis to the extending direction.

Advantageous Effects of Invention

With the medium storage box and the medium processing device according to the exemplary embodiment described above, it is possible to improve reliability.

DESCRIPTION OF EMBODIMENTS

Hereinafter, an exemplary embodiment and some modifications thereof, are described in detail with reference to the drawings. The description is given in the following order.

1. Exemplary Embodiment (an example of a handle in which arms include inclined surfaces extending from end portions of an upper surface portion)
2. Modification Examples
   - Modification Example 1 (examples of the handle in which a grip portion is arranged at a position separated from the upper surface portion of the arms)
   - Modification Example 2 (examples of the handle in which the inclined surfaces are not provided)
   - Modification Example 3 (other exemplary configurations related to a fitting structure between a rotational axis of the handle and a storage unit)
3. Other Modification Examples

1. Exemplary Embodiment

Configuration of a Banknote Pay-in/Pay-Out Device 1

Figure 1:
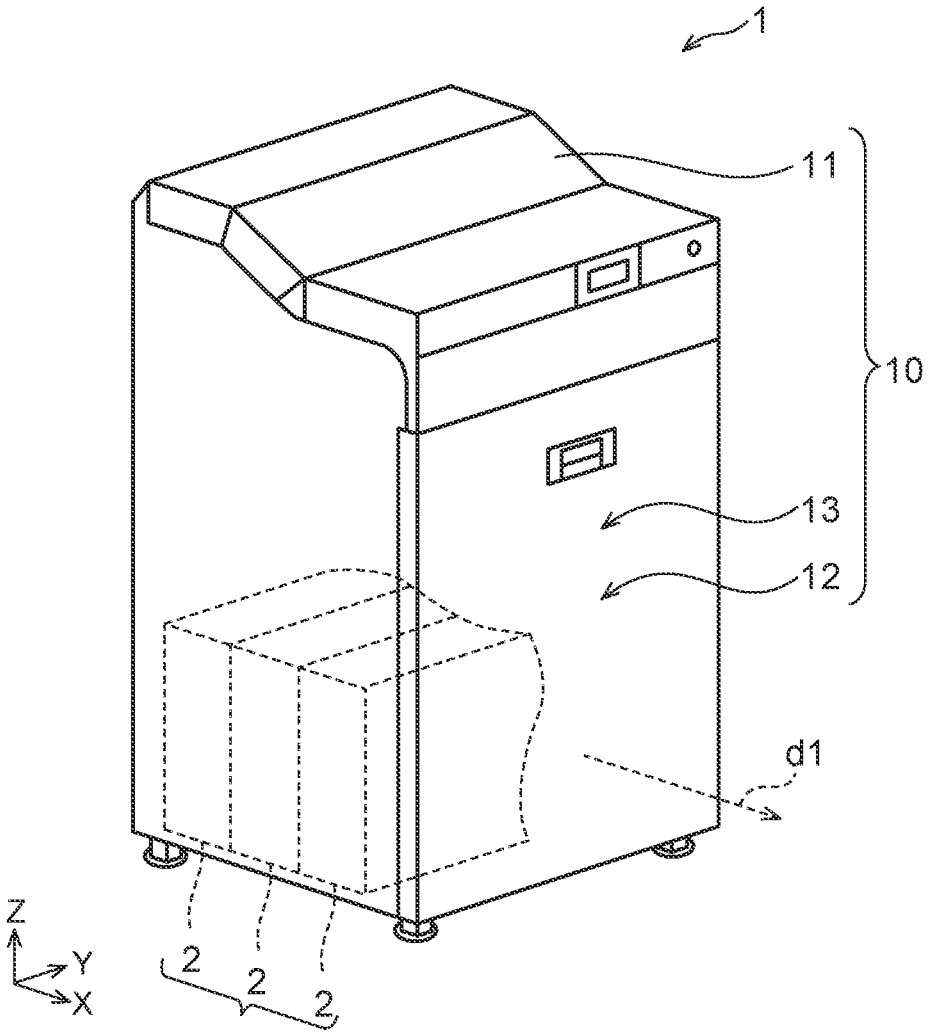
FIG. 1 is a schematic perspective view illustrating an external configuration example of a medium processing device according to an exemplary embodiment of the present disclosure.

FIG. 1 is a schematic perspective view illustrating an example of an external configuration of a banknote pay-in/pay-out device 1 as a medium processing device according to an embodiment of the present disclosure. The banknote pay-in/pay-out device 1 is installed, for example, in a financial institution, and serves as a device to perform various transactions with a user (pay-in transactions or pay-out transactions) related to banknotes as a medium. The banknote pay-in/pay-out device 1 is only one specific example of a "medium processing device" in the present disclosure, and the banknotes is merely one specific example of a "medium" in the present disclosure.

As illustrated in FIG. 1, the banknote pay-in/pay-out device 1 includes a main body 10 and one or more banknote storage boxes 2 (banknote storage cassettes) that are attachable to and detachable (loadable) from the inside of the main body 10. In this example, three banknote storage boxes are provided. The main body 10 includes an operation cover 11, a lower unit 12 and a conveyance unit 13. A banknote storage box 2 is only one specific example of a "medium storage box" (medium storage cassette) in the present disclosure.

As illustrated in FIG. 1, each banknote storage box 2 is used for replenishing and collecting banknotes, and is configured to be able to internally store banknotes. As described above, the banknote storage boxes 2 are each configured to be attachable to and detachable from the main body 10. In this example, as illustrated in FIG. 1, the banknote storage boxes 2 are arranged in the X-axis direction in the main body 10 (lower unit 12).

As illustrated in FIG. 1, the operation cover 11 is arranged on an upper surface portion of the main body 10. For example, the operation cover 11 is provided with an operation monitor, a pay-in/pay-out port, an operation unit and the like, which are not illustrated.

The lower unit 12 is a unit that internally accommodates the banknote storage boxes 2 and is arranged to securely enclose by a safe, which is not illustrated, in the main body 10. As described later in detail, the lower unit 12 can be pulled out to the exterior of the banknote pay-in/pay-out device 1, for example, in a direction d1 (the X-axis direction or a front surface side) illustrated in FIG. 1. As a result, it is possible to attach/detach banknote storage boxes 2 to and from the main body 10, and therefore the banknotes are replenished to and collected from the banknote storage boxes 2.

Figure 2:
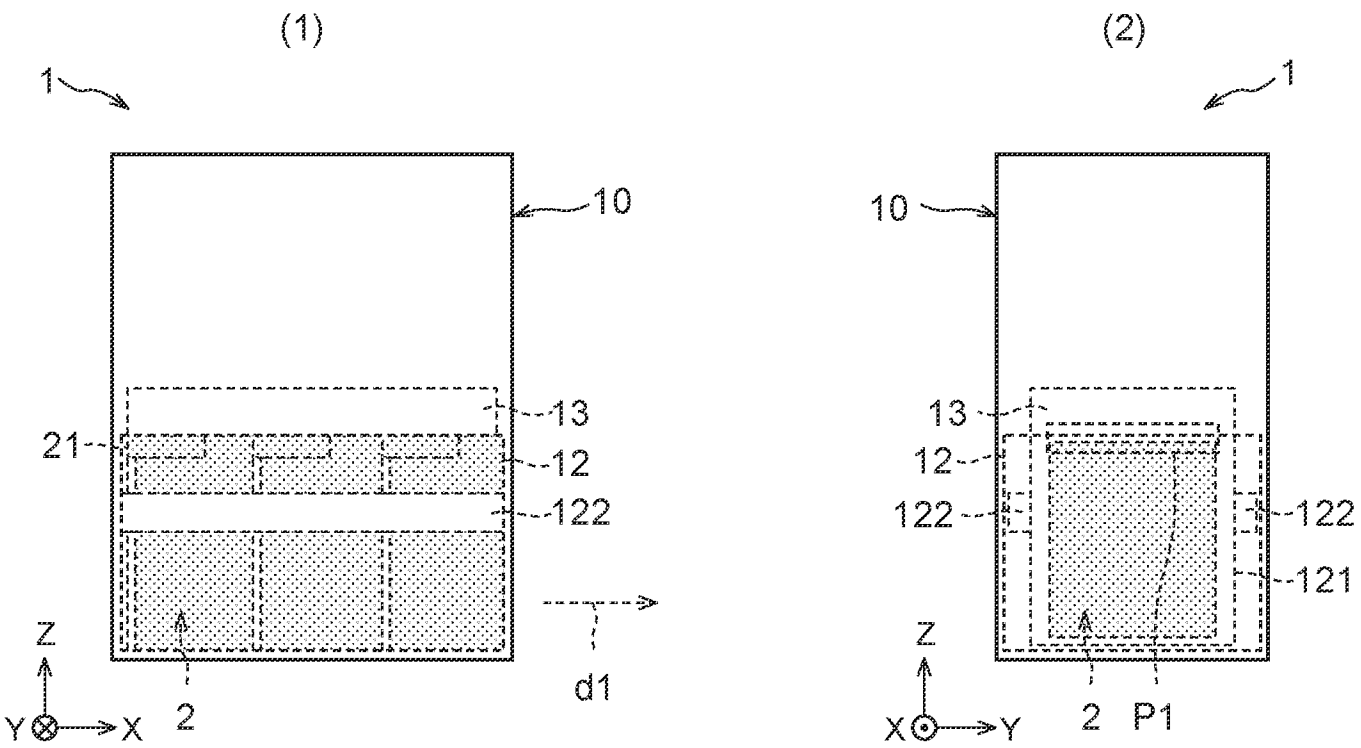
FIG. 2 is a schematic view illustrating a detailed configuration example of the medium processing device illustrated in FIG. 1.
Figure 3:
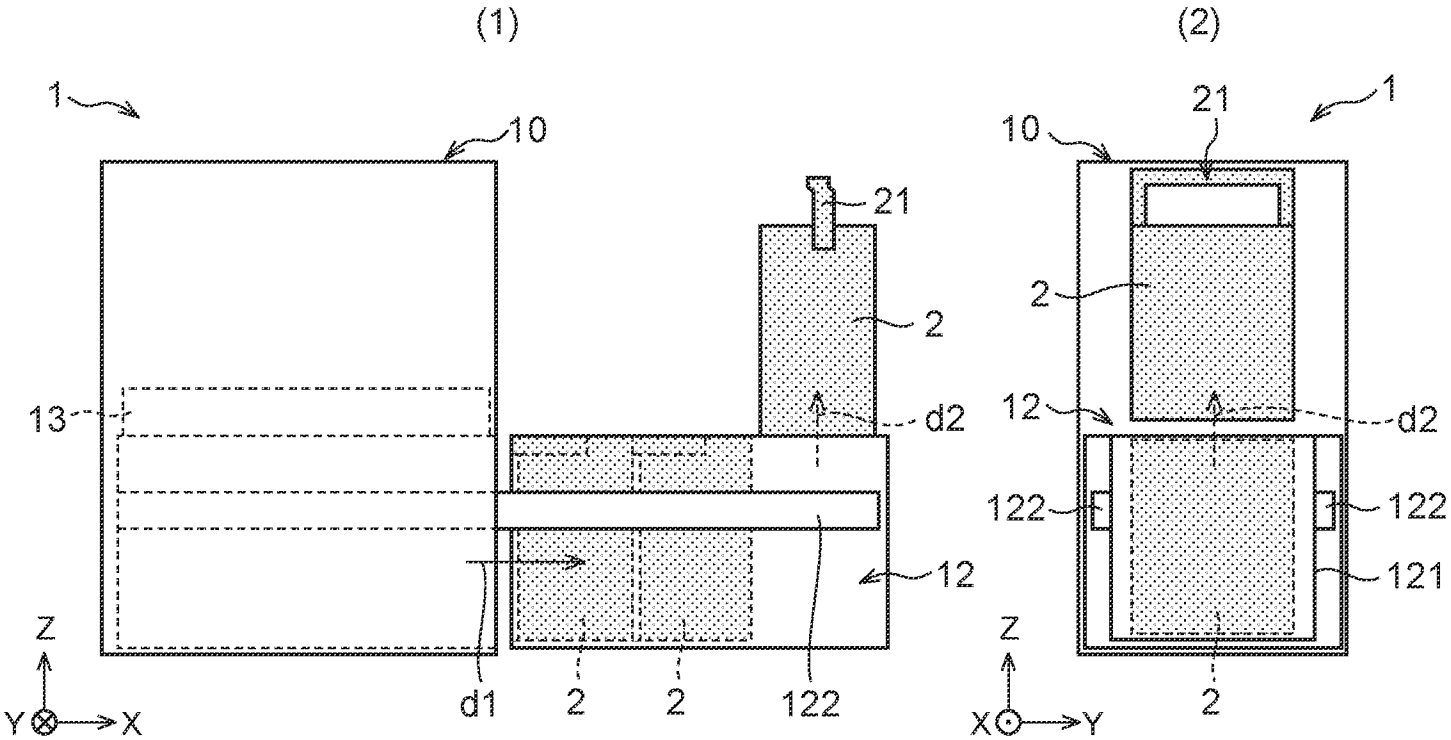
FIG. 3 is a schematic view illustrating an example of a state in which a medium storage box is moved from inside of the medium processing device to outside the medium processing device illustrated in FIG. 1.

Here, a detailed example of a configuration of the banknote pay-in/pay-out device 1 will be described with reference to FIG. 2 and FIG. 3. FIG. 2 is a schematic view illustrating this detailed example. FIG. 2(1) illustrates an example of the Z-X side surface configuration. FIG. 2(2) illustrates an example of the Y-Z side surface configuration. Further, FIG. 3 is a schematic view illustrating an example of a state in which the banknote storage box 2 is removed from inside of the banknote pay-in/pay-out device 1 to outside the banknote pay-in/pay-out device 1. FIG. 3(1) illustrates an example of the Z-X side surface configuration. FIG. 3(2) illustrates an example of the Y-Z side surface configuration.

As illustrated in FIG. 2 and FIG. 3, the lower unit 12 described above includes a cassette storage box 121 and slide rails 122.

The cassette storage box 121 is a storage box that individually accommodates the banknote storage box 2 and can be pulled out to the exterior of the banknote pay-in/pay-out device 1 by using slide rails 122 to be described later.

The slide rails 122 are rails for use to pull out the lower unit 12 from within the banknote pay-in/pay-out device 1 to the exterior of the banknote pay-in/pay-out device 1. Specifically, as illustrated in FIG. 2(1) and FIG. 3(1), the lower unit 12 is pulled out to the exterior of the banknote pay-in/pay-out device 1 in the direction d1 by using the slide rails 122. In this example, the slide rails 122 are arranged at both side surfaces in the Y-axis direction in the cassette storage box 121 and extend in the X-axis direction (the direction d1).

The conveyance unit 13 is a unit that conveys (carries) the banknotes into the banknote storage box 2 and is arranged at a side of the main body 10. Thus, in this example, the conveyance unit 13 remains at the side of the main body 10 when the lower unit 12 is pulled out to the exterior of the banknote pay-in/pay-out device 1.

Configuration of the Banknote Storage Box 2

Figure 4:
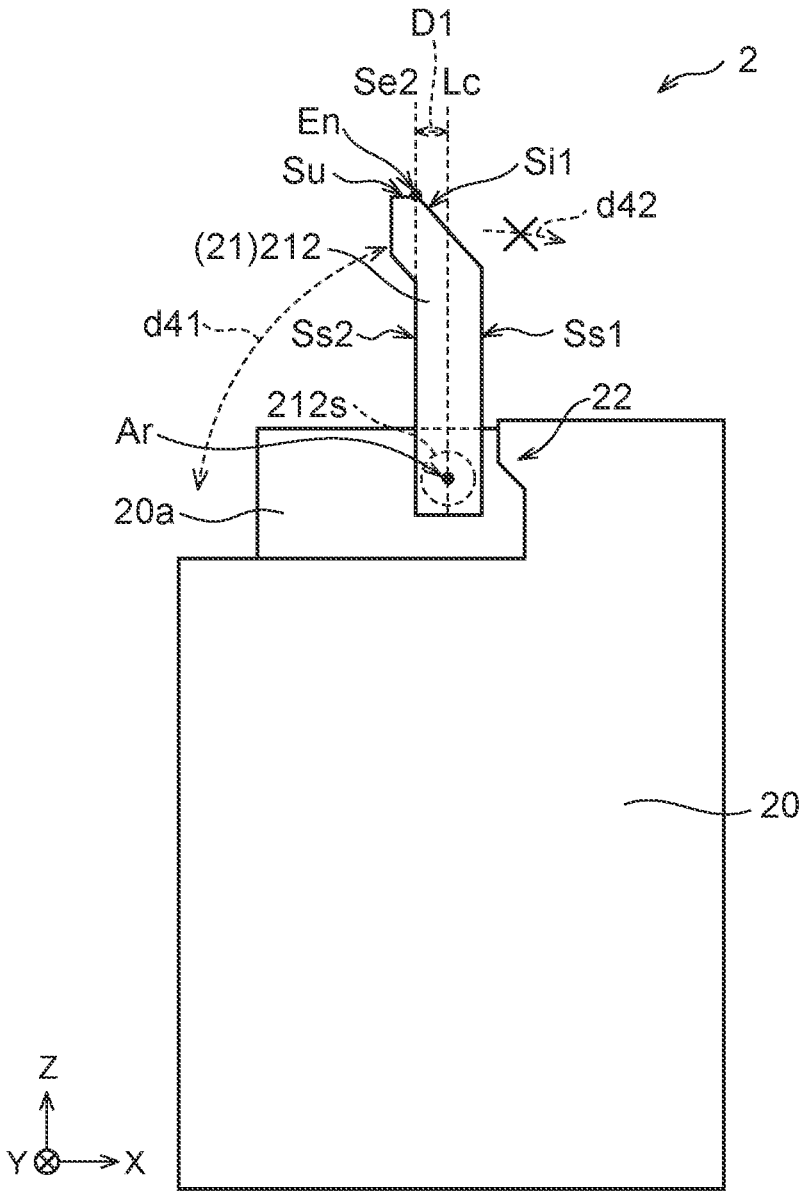
FIG. 4 is a schematic view illustrating a detailed configuration example of the medium storage box illustrated in FIG. 1.
Figure 5:
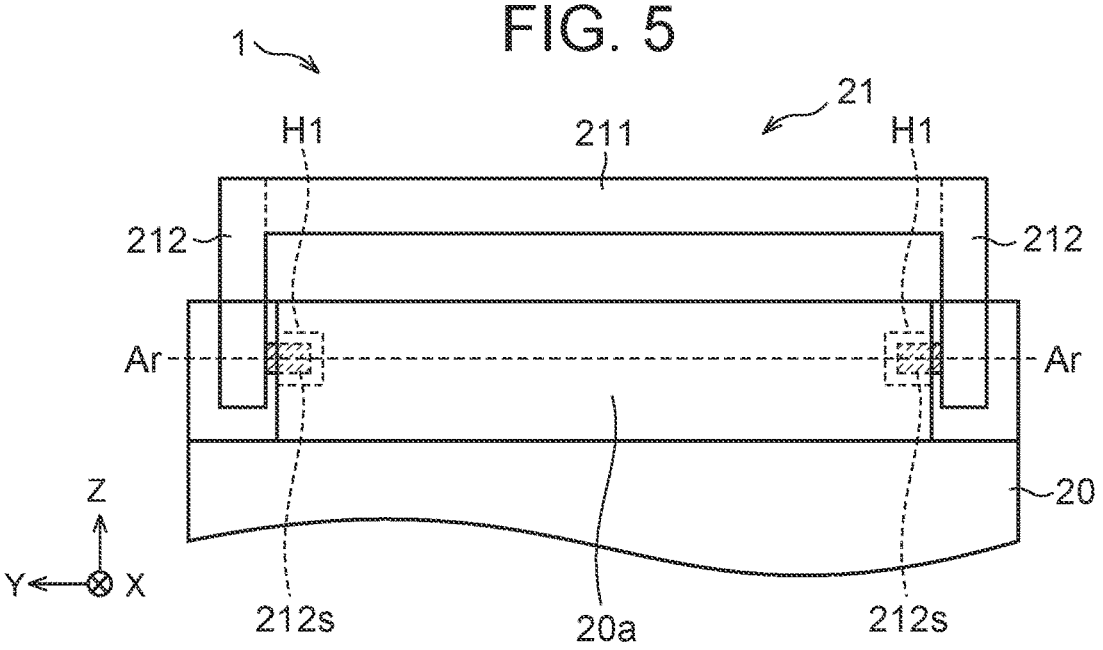
FIG. 5 is a schematic view illustrating a general configuration example of a handle illustrated in FIG. 4.

Next, an example of the configuration of the banknote storage box 2 will be described with reference to FIG. 4, FIG. 5, FIG. 6A, FIG. 6B, FIG. 7A and FIG. 7B. FIG. 4 is a schematic Z-X side surface view illustrating in detail the exemplary configuration of the banknote storage box 2. FIG. 5 is a schematic Y-Z side surface view illustrating the exemplary general configuration of the handle illustrated in FIG. 4 (a handle 21 described later).

As illustrated in FIG. 4 and FIG. 5, the banknote storage box 2 includes a storage unit 20, the handle 21 and a stopper 22.

The storage unit 20 is for internally storing banknotes. As illustrated in FIG. 4 and FIG. 5, the upper portion of the storage unit 20 is provided with a handle attachment portion 20*a* as a portion to which the handle 21 to be described later is attached.

The handle 21 is used when the banknote storage box 2 is attached and detached or is transported, and is attached to the handle attachment portion 20*a* of the storage unit 20 as described above. As illustrated in FIG. 4 and FIG. 5, in a portion of the handle 21 attached to the storage unit 20 (the handle attachment portion 20*a*), a rotational axis Ar when rotating the handle 21 extends in the Y-axis direction. That is, for example, as illustrated in the direction d41 of FIG. 4, the handle 21 is configured to be rotatable in the Z-X plane with respect to the storage unit 20 around the rotational axis Ar as a center.

Figure 6A:
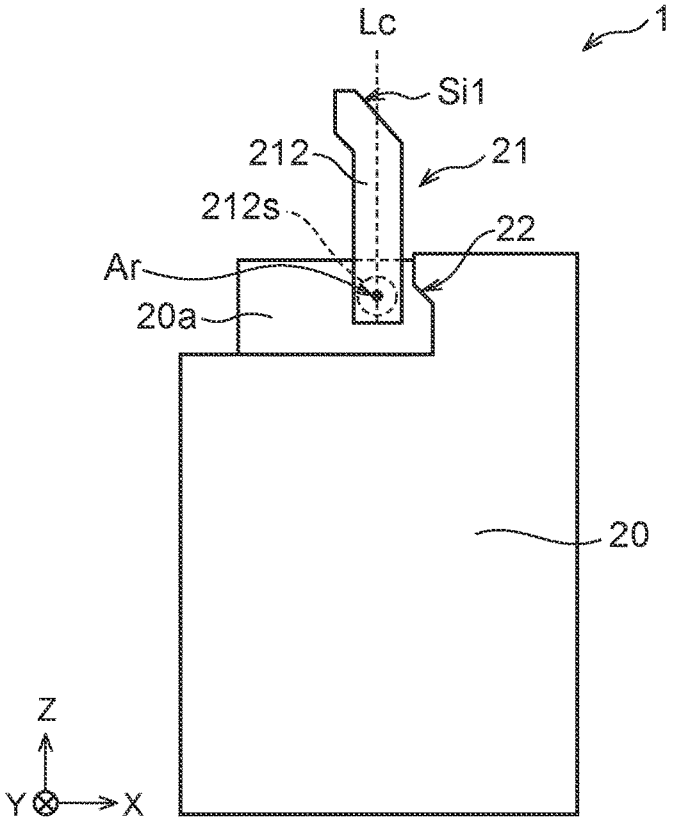
FIG. 6A is a schematic view illustrating a standing state of the handle in the medium storage box illustrated in FIG. 4.
Figure 6B:
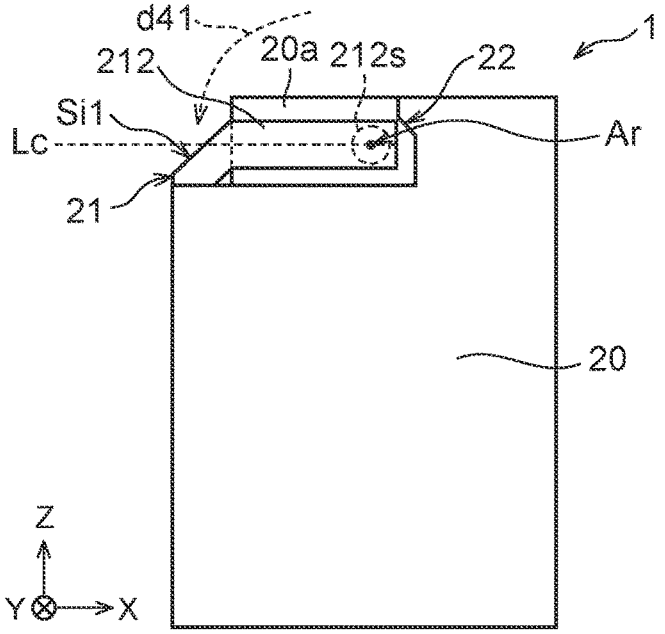
FIG. 6B is a schematic view illustrating a lying state of the handle in the medium storage box illustrated in FIG. 4.

Specifically, for example, as illustrated in FIG. 6A and FIG. 6B, the handle 21 can rotate in both directions between a standing state (see FIG. 6A) with the respect to the storage unit 20 and a lying state (see FIG. 6B) with respect to the storage unit 20. In other words, the standing state illustrated in FIG. 6A is a state in which the handle 21 protrudes from the upper surface portion of the storage unit 20. As described above, the standing state is set when the banknote storage box 2 is attached, detached or transported (see, FIG. 3(1)). On the other hand, the lying state illustrated in FIG. 6B is a state (fall state, see the direction illustrated in FIG. 6B) in which the handle 21 does not protrude from the upper surface portion of the storage unit 20. The lying state is set when the banknote storage box 2 is accommodated in the main body 10 (see FIG. 2(1)). The standing state illustrated in FIG. 6A corresponds to one specific example of a "first state" in the present disclosure, and the lying state illustrated in FIG. 6B corresponds to the one specific example of a "second state" in the present disclosure.

As illustrated in FIG. 5, the handle 21 includes a grip portion 211 and a pair of arms 212.

The grip portion 211 is gripped by an operator when the banknote storage box 2 is attached, and detached or transported. As illustrated in FIG. 5, the grip portion 211 extends in the parallel direction (Y-axis direction) of the rotational axis Ar of the handle 21.

As illustrated in FIG. 4, each of the two arms 212 has a substantially bar-shape that extends in an extending direction (Z-axis direction) from the rotational axis Ar (a portion attached to the handle attachment portion 20*a*) toward an upper surface portion (arm upper surface portion) Su located at a side of the grip portion 211. As illustrated in FIG. 5, each of arms 212 is a portion extending from the rotational axis Ar (the handle attachment portion 20*a*) toward the grip portion 211. Further, each of the arms 212 includes two side surfaces Ss1 and Ss2 which oppose each other and extend in the extending direction, and an inclined surface Si1 connecting the side surface Ss1 and the upper surface portion Su. The side surface Ss1 corresponds to one specific example of a "first side surface" in the present disclosure, and the side surface Ss2 corresponds to one specific example of a "second side surface" in the present disclosure.

As illustrated in FIG. 5, for example, each of the arms 212 is attached to the handle attachment portion 20*a* of the storage unit 20 in the vicinity of the rotational axis Ar in the handle 21. That is, a handle fulcrum portion (projecting portion) 212*s* provided on each of the arms 212 is fitted into each of two fitting holes (fitting grooves) H1 formed at the handle attachment portion 20*a*, and therefore each of the arms 212 is attached to the handle attachment portion 20*a*.

As illustrated in FIG. 4, for example, the stopper 22 is provided in the vicinity of the rotational axis Ar in the upper portion of the storage unit 20, thereby restricting a direction of rotation of the handle 21 to one direction (one-way direction). In other words, the handle 21 in its standing state is restricted to rotation in only one direction (away from the stopper). Specifically, when the handle 21 rotates from the standing state (see FIG. 6A) to the lying state (see FIG. 6B), the stopper 22 allows rotation of the handle 21 in the direction d41, while the stopper 22 restricts rotation of the handle 21 in the direction d42, which is opposite to the direction d41 (see "×" mark in FIG. 4). In other words, the stopper 22 restricts the rotation of the handle 21 in a direction d42 so as not to rotate the handle 21 in the direction d42. The stopper 22 corresponds to one specific example of "rotation restricting portion" in the present disclosure. Further, the direction d41 corresponds to one specific example of a "first direction" in the present disclosure, and the direction d42 corresponds to one specific example of a "second direction" in the present disclosure.

The stopper 22 is provided at the storage unit 20, and the two arms 212 have a shape that allows them to easily fall in the direction of rotation (the direction d41) of the handle 21 (a shape in which the center of gravity of the arms 212 is located on the side toward which the direction d41 extends, hereinafter "the direction d41 side") as will be described later. That is, for example, it is possible to eliminate the possibility of trouble caused by an operation of returning the lower unit 12 into the banknote pay-in/pay-out device 1 while the handle 21 remains in the standing state. Specifically, for example, it is possible to eliminate the possibility that these members become damaged due to the handle 21 colliding with the casing of the main body 10 of the banknote pay-in/pay-out device.

FIG. 4 illustrates in the handle 21 of the present exemplary embodiment, a specific example of a shape of each of the arms 212 in which the center of gravity of the arms 212 is located on the direction d41 side.

That is, first, in each of these arms 212, an end portion En (proximal end) of an arm center line Lc side in the upper surface portion Su of the arms 212 is separated toward the direction d41 side with respect to the arm center line Lc extending from the rotational axis Ar to the extending direction (Z-axis direction) of the arms 212. Specifically, as illustrated in FIG. 4, the end portion En of the upper surface portion Su is separated from the arm center line Lc by a predetermined distance (separation distance D1). The end portion En of the upper surface portion Su described above corresponds to one specific example of "an end portion of an arm center line side" in the present disclosure.

As illustrated in FIG. 4, each of the arms includes an inclined surface Si1 inclined from the end portion En of the upper surface portion Su toward the direction d42 extends, hereinafter the direction d42 side (the side opposite to the side toward which the rotation direction of the handle 21 extends). Specifically, in an example illustrated in FIG. 4, the inclined surface Si1 extends from the end portion En of the upper surface portion Su to a position beyond the arm center line Lc toward the side surface Ss1 of the arms 212. In other words, the inclined surface Si1 is continuously formed from the end portion En of the upper surface portion Su to the side surface Ss1.

Further, as illustrated in FIG. 4, in each of the arms 212, the end portion En of the upper surface portion Su is positioned on the surface of an extended surface Se2 along the extending direction (X-axis direction) of the arms 212 from the side surface Ss2, or is positioned to separate from the extended surface Se2 toward the direction d41 side (the direction of rotation of the handle 21). Specifically, in an example illustrated in FIG. 4, the end portion En of the upper surface portion Su is positioned on the surface of the extended surface Se2 of the side surface Ss2.

Figure 7A:
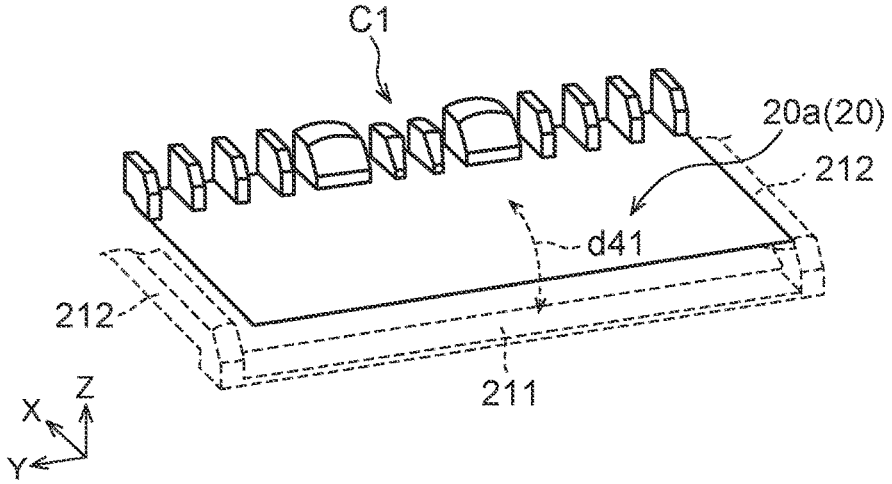
FIG. 7A is a schematic perspective view illustrating an example of a concave and convex structure in the medium storage box illustrated in FIG. 4.
Figure 7B:
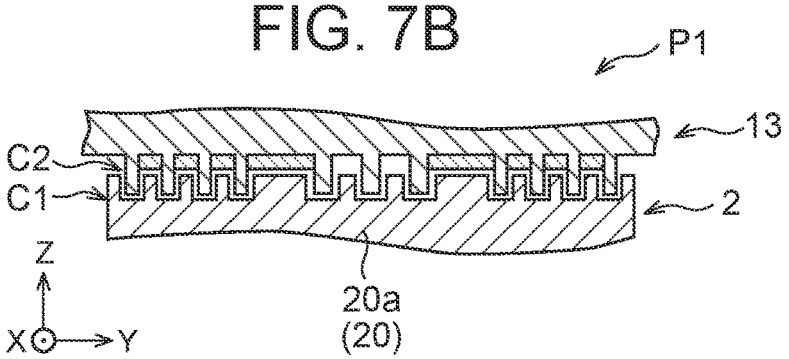
FIG. 7B is a schematic view illustrating in cross section an exemplary configuration, including the concave and convex structure of the medium storage box illustrated in FIG. 7A.

For example, as illustrated in FIG. 7A and FIG. 7B, the upper surface portion of the storage unit 20 (handle attachment portion 20*a*) according to the present exemplary embodiment is provided with the following concave and convex structure C1. FIG. 7A is a schematic perspective view illustrating an example of the concave and convex structure C1 of the banknote storage box 2. FIG. 7B is a schematic view illustrating an example of the cross-sectional configuration including the concave and convex structure C1 of the banknote storage box 2 illustrated in FIG. 7A, and corresponds to an example of an enlarged cross-sectional configuration of a mark P1 portion (a connecting portion between the storage unit 20 of the banknote storage box 2 and the conveyance unit 13) illustrated in FIG. 2(2) described above.

As illustrated in FIG. 7A and FIG. 7B, the upper surface portion (a connecting surface with the conveyance unit 13) of the storage unit 20 (the handle attachment portion 20*a*) is provided with the concave and convex structure C1 of a comb tooth shape with teeth extending in the Y-axis direction. On the other hand, as illustrated in FIG. 7B, a lower surface portion (a connecting surface with the storage unit 20) of the conveyance unit 13 is also provided with a concave and convex structure C2 of a comb tooth shape with teeth extending in the Y-axis direction as a conveyance guide for banknotes. As illustrated in FIG. 7B, the convex portions and the concave portions are alternately arranged in the concave and convex structure C1 and the concave and convex structure C2, thereby forming a nested shape. In the banknote pay-in/pay-out device 1, the concave and convex structures C1 and C2 are formed, and therefore the banknotes are smoothly handed over at the connecting portion between the storage unit 20 of the banknote storage box 2 and a handover guide of the conveyance unit 13. Moreover, as described above, when the lower unit 12 (banknote storage box 2) is pulled out from or is returned to the banknote pay-in/pay-out device 1, the concave and convex structures C1 and C2 forming the nested shape are arranged to pass each other.

Operation and Workings/Effects

A. Basic Operation of Banknote Pay-in/Pay-Out Device 1

As illustrated in FIG. 1, the banknote pay-in/pay-out device 1 is operated by the operator using an operation monitor, an operation unit, etc. provided in the operation cover 11, thereby executing various transactions such as pay-in transactions and pay-out transactions of banknotes. Specifically, for example, the banknotes inserted into the pay-in/pay-out port provided in the operation cover 11 are stored in the banknote storage box 2 accommodated in the lower unit 12 in the main body 10 via the conveyance unit 13, etc., and therefore the banknotes are deposited to the banknote pay-in/pay-out device 1. On the other hand, for example, the banknotes stored in the banknote storage box 2 are carried out of the pay-in/pay-out port via the conveyance unit 13, etc., and thereby is withdrawn from the banknote pay-in/pay-out device 1.

Here, when replenishing and collecting banknotes with respect to the banknote storage box 2 accommodated in the main body 10 (lower unit 12) of the banknote pay-in/pay-out device 1, for example, the banknote storage box 2 is moved to the exterior of the main body 10 as described in the following.

Specifically, first, the lower unit 12 is pulled out from the banknote pay-in/pay-out device 1 to its exterior in the direction d1 (X-axis direction) illustrated in FIG. 1, FIG. 2(1) and FIG. 3(1) by using the slide rails 122. Then, the handle 21 (grip portion 211) of the banknote storage box 2 is gripped by the operator, and therefore the banknote storage box 2 is taken out of the lower unit 12 in the direction d2 (Z-axis direction) illustrated in FIG. 3(1) and FIG. 3(2).

At this time, the handle 21 of the banknote storage box 2 moves from the lying state illustrated in FIG. 6B to the standing state illustrated in FIG. 6A, and therefore the operator can lift up the banknote storage box 2 (in the direction d2) by using the handle 21 of the standing state. Thus, the banknote storage box 2 taken out of the main body 10 is replenished with banknotes and banknotes are collected from it.

B. Workings and Effects in the Banknote Storage Box 2

Here, when the banknote storage box 2 is taken out of the main body 10 (lower unit 12) to the exterior of the main body 10, a case where the banknote storage box 2 has unintentionally fallen will be described while making a comparison with a comparative example.

B-1. Comparative Example

Figure 8:
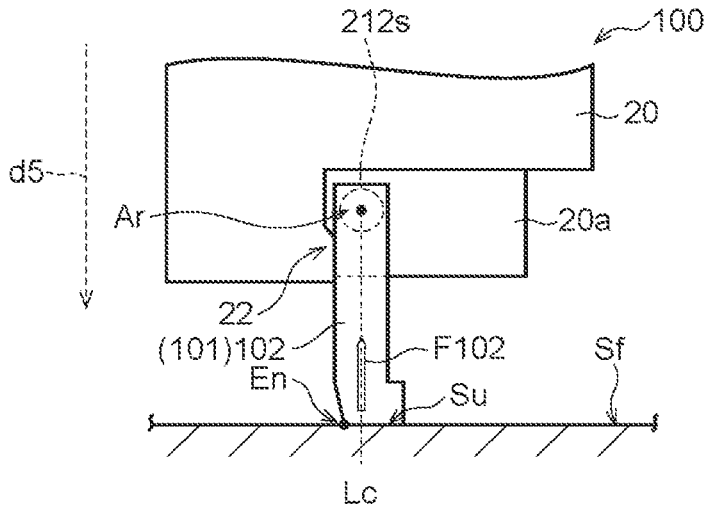
FIG. 8 is a schematic view illustrating an example of a situation in which the medium storage box according to a comparative example falls onto the floor surface.

FIG. 8 is a schematic view illustrating an example of a situation (falling situation to the direction d5 which is the vertical direction) in which the banknote storage box (banknote storage box 100) according to the comparative example falls onto the floor surface (ground) Sf in an upside down orientation in which its top end faces downward (in the direction d5). The banknote storage box 100 of the comparative example corresponds to a handle 101 (a pair of arms 102) provided instead of the handle 21 (the pair of arms 212) in the banknote storage box 2 of the present exemplary embodiment illustrated in FIG. 4, but the other configurations are the same.

As illustrated in FIG. 8, each of the two arms 102 in the handle 101 of this comparative example is configured as follows. Unlike the pair of arms 212 of the handle 21 of the present exemplary embodiment illustrated in FIG. 4, in each of the arms 102, the end portion En of the upper surface portion Su is positioned to separate from the arm center line Lc in a direction opposite side (the direction d42 described above) to the rotation direction, not the direction d41 which is the rotation direction of the handle 101 with respect to the arm center line Lc. In other words, in each of the arms 212 of the present exemplary embodiment, the end portion En of the upper surface portion Su is separated from the arm center line Lc toward the rotation direction (direction d41) side of the handle 21, while in each of the arms 102 of the comparative example, the end portion En of the upper surface portion Su is separated toward a rotation restricting direction (direction d42) side of the handle 101.

With the above configuration, in the banknote storage box 100 of the comparative example, as illustrated by the direction d5 of FIG. 8, for example, the following problem may occur when the banknote storage box 100 falls onto the floor surface Sf in a posture in which the handle 101 is positioned downward in the standing state (in a posture in which the handle 101 hangs downward by gravity). That is, first, when the handle 101 (arms 102) comes into contact with the floor surface Sf, as illustrated in FIG. 8, for example, a large external force F102 is applied from the contact position toward the handle fulcrum portion 212*s* and the fitting hole H1. When the large external force F102 is applied, there is a possibility that partial deformation of or damage (for example, deformation of or partial damage to the handle fulcrum portion 212*s*) in the banknote storage box 100 will occur or the handle 101 will not fall (the handle 101 will not return from the standing state to the lying state). Further, for example, in a case where the arms 102 incline and hang in the rotation restricting direction of the stopper 22 side, a portion of the rotational axis Ar side of the arms 102 comes into contact with the stopper 22, and therefore it is possible for such partial deformation, damage, or the like to occur. As a result, it is possible to lose the reliability in the banknote storage box 100 of the comparative example.

B-2. Present Exemplary Embodiment

On the other hand, as illustrated in FIG. 4, and unlike the arms 102 of the handle 101 of the comparative example described above, each of the two arms 212 of the handle 21 of the present exemplary embodiment is configured as follows. That is, in each of the arms 212, the end portion En of the upper surface portion Su is separated from the arm center line Lc toward the direction d41 side, which is the rotation direction of the handle 21 with respect to the arm center line Lc (see the separation distance D1).

Figure 9:
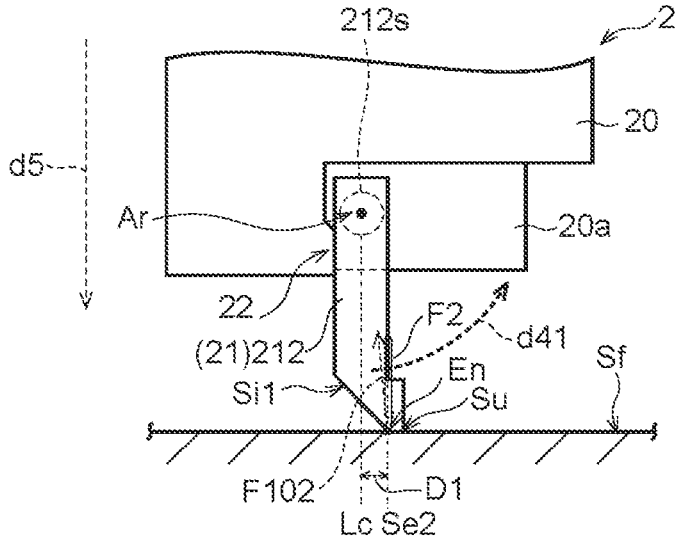
FIG. 9 is a schematic view illustrating an example of a situation in which the medium storage box illustrated in FIG. 4 falls onto the floor surface.
Figure 10:
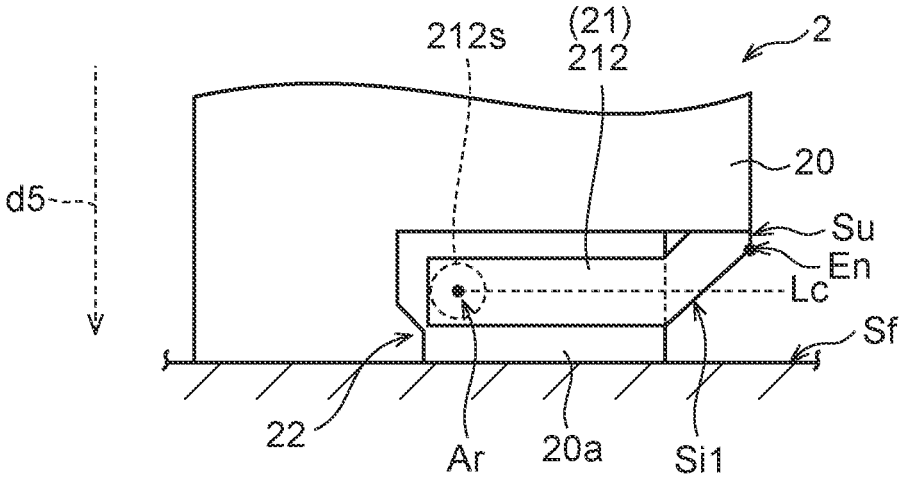
FIG. 10 is a schematic view illustrating an example of a state after the medium storage box illustrated in FIG. 4 falls onto the floor surface.

For example, unlike the comparative example described above and as illustrated by the direction d5 in FIG. 9, even if the banknote storage box 2 inadvertently falls onto the floor surface Sf in a posture in which the handle 21 is positioned downward in the standing state (in a posture in which the handle 21 hangs downward by gravity), the banknote storage box 2 of the present exemplary embodiment is as follows. That is, first, when the handle 21 (arms 212) comes into contact with the floor surface Sf, due to a gap (see the separation distance D1) toward the direction d41 side of the contact position, as illustrated in FIG. 9, for example, an upward force F2 in the vertical direction acts to the arms 212. Thus, when the handle 21 comes into contact with the floor surface Sf, the handle 21 (arms 212) tends to fall toward the direction d41 side (the rotation direction of the handle 21, the direction opposite to the direction d42 which is the rotation restricting direction), and therefore the handle 21 returns smoothly from the standing state to the lying state as illustrated in FIG. 10, for example. Hence, the banknote storage box 2 adopts this fallen state.

That is, unlike the comparative example, the present exemplary embodiment responds to a fall as follows. The occurrence of the external force F102 applied from the contact position with the floor surface Sf toward the handle fulcrum portion 212*s* and the fitting hole H1 is reduced or eliminated (see the external force F102 illustrated by the broken line in FIG. 9) and the rotation moment component toward the direction d41 side in the arms 212 is generated. Thus, in the present exemplary embodiment, for example, as described above, it is possible to eliminate the possibility that partial deformation or damage (for example, deformation of or partial damage to the handle fulcrum portion 212*s*) in the banknote storage box 2 will occur or the handle 21 will fall. As a result, it is possible to improve reliability as compared with the banknote storage box 100 of the comparative example in the banknote storage box 2 of the present exemplary embodiment.

It is desirable that the end portion En of the upper surface portion Su in the arms 212 is as far as possible from the arm center line Lc (the separation distance D1 is as large as possible) from the viewpoint of making the handle 21 easy to fall in the direction d41. This is because the rotation moment component of the arms 212 increases as the separation distance D1 increases, and therefore the handle 21 easily falls.

As illustrated in FIG. 4, in the present exemplary embodiment, each of the arms 212 in the handle 21 is provided with the inclined surface Si1 which is inclined from the end portion En of the upper surface portion Su toward the direction d42 side (rotation restricting direction). As a result, the handle 21 (arms 212) easily falls further toward the direction d41 side, thereby further improving reliability in the banknote storage box 2.

Further, as illustrated in FIG. 4, in the present exemplary embodiment, in each arm 212 the inclined surface Si1 extend from the end portion En of the upper surface portion Su to a position beyond the arm center line Lc, toward the side surface Ss1. In other words, the inclined surface Si1 is continuously formed from the end portion En of the upper surface portion Su to the side surface Ss1. As a result, for example, the handle 21 (arms 212) easily falls toward the direction d41 side as compared with a case where inclined surface Si1 of each arm is formed only halfway to the side surface Ss1, thereby further improving reliability of the banknote storage box 2.

In addition, as illustrated in FIG. 4, in the present exemplary embodiment, in each arm, the end portion En of the upper surface portion Su is positioned on the surface of the extended surface Se2 along the extending direction of the arms from the side surface Ss2, or is positioned to separate toward the direction d41 side with respect to the extended surface Se2. In this way, the end portion En of the upper surface portion Su of each arm is far away from the arm center line Lc (the separation distance D1 is relatively large), and therefore the moment of rotation component of the arms 212 further increases and the handle 21 further easily falls as described above. As a result, it is possible to improve reliability of the banknote storage box 2.

In particular, in the present exemplary embodiment, as illustrated in FIG. 4, the end portion En of the upper surface portion Su of each arm is positioned on the surface in the extended surface Se2 of the side surface Ss2. In this way, as described above, the handle 21 can more easily fall, and the strength of the handle 21 (arms 212) can also be secured. As a result, in addition to eliminating the possibility of partial deformation of or damage to the banknote storage box 2, it is possible to further improve the reliability of the banknote storage box 2 from the viewpoint of securing the strength of the handle 21.

Figure 11:
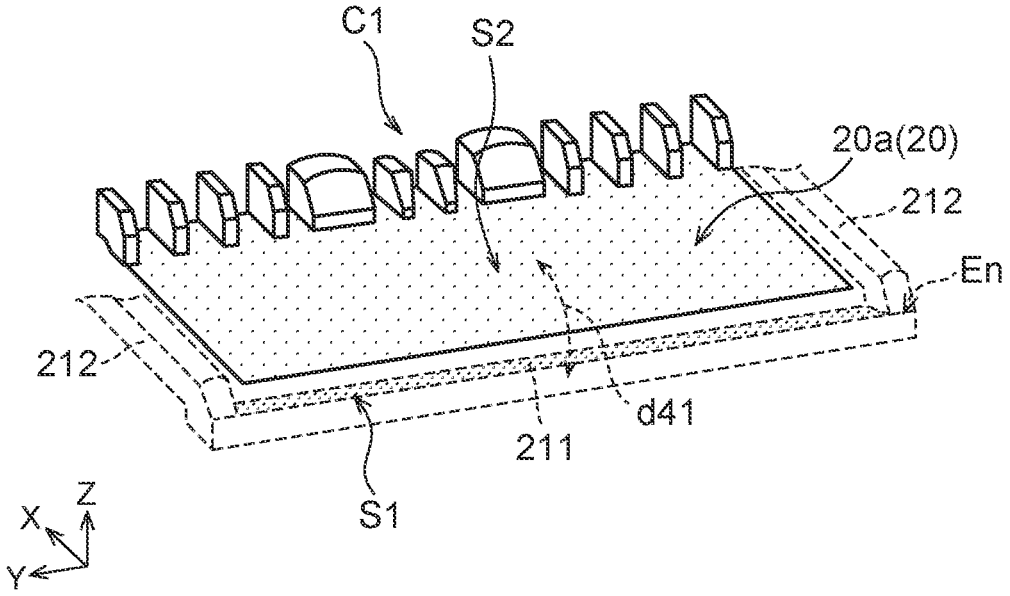
FIG. 11 is a schematic perspective view illustrating another exemplary configuration (an application example) of the medium storage box according to the exemplary embodiment.

As a specific detailed example of the application (modification example) of the present exemplary embodiment illustrated in FIG. 11, for example, in the lying state of the handle 21, it is desirable that a height (position) Z1 of the X-axis direction in the upper surface S1 (X-Y plane) of the grip portion 211 is as follows. That is, first, it is desirable that the height Z1 in the upper surface S1 of the grip portion 211 is aligned with the height in the X-axis direction of the end portion En in the arms 212. Moreover, it is desirable that the height Z1 in the upper surface S1 of the grip portion 211 is equal to a height Z2 in the Z-axis direction in the upper surface S2 (the X-Y plane in which the concave and convex structure C1 is formed) of the storage unit 20 in the banknote storage box 2 (Z1=Z2) or the height Z1 is slightly lower than the height Z2. In such a configuration, for example, as compared with the case of the configuration of FIG. 7A described above, the grip portion 211 can be formed thicker, and therefore it is possible to improve the strength of the handle 21. In the case where a nested shape by the concave and convex structures C1 and C2 described above is formed, the concave and convex structure C2 of the conveyance unit 13 does not interfere with the upper surface of the grip portion 211, and therefore it is also possible to reduce the size of the handle 21.

As described above, in the present exemplary embodiment, each of the two arms 212 of the handle 21 of the banknote storage box 2 is as follows since the end portion En of the upper surface portion Su is separated from the arm center line Lc toward the direction d41 side (the rotation direction of the handle 21). That is, for example, even if the banknote storage box 2 inadvertently falls onto the floor surface Sf in a posture in which the handle 21 is positioned downward in the standing state, the handle 21 (arms 212) easily falls toward the direction d41 side when the handle 21 (arms 212) comes into contact with the floor surface Sf. Thus, when the handle 21 comes into contact with the floor surface Sf, it is possible to eliminate the possibility of partial deformation of or damage to the banknote storage box 2 and improve reliability of the banknote storage box 2.

2. Modification Example

Subsequently, modification examples (modifications 1 to 3) of the above exemplary embodiment will be described. It is to be noted that components substantially the same as those in the exemplary embodiment may be denoted with the same numerals, and will not be described further where appropriate.

Modification Example 1

Figure 12:
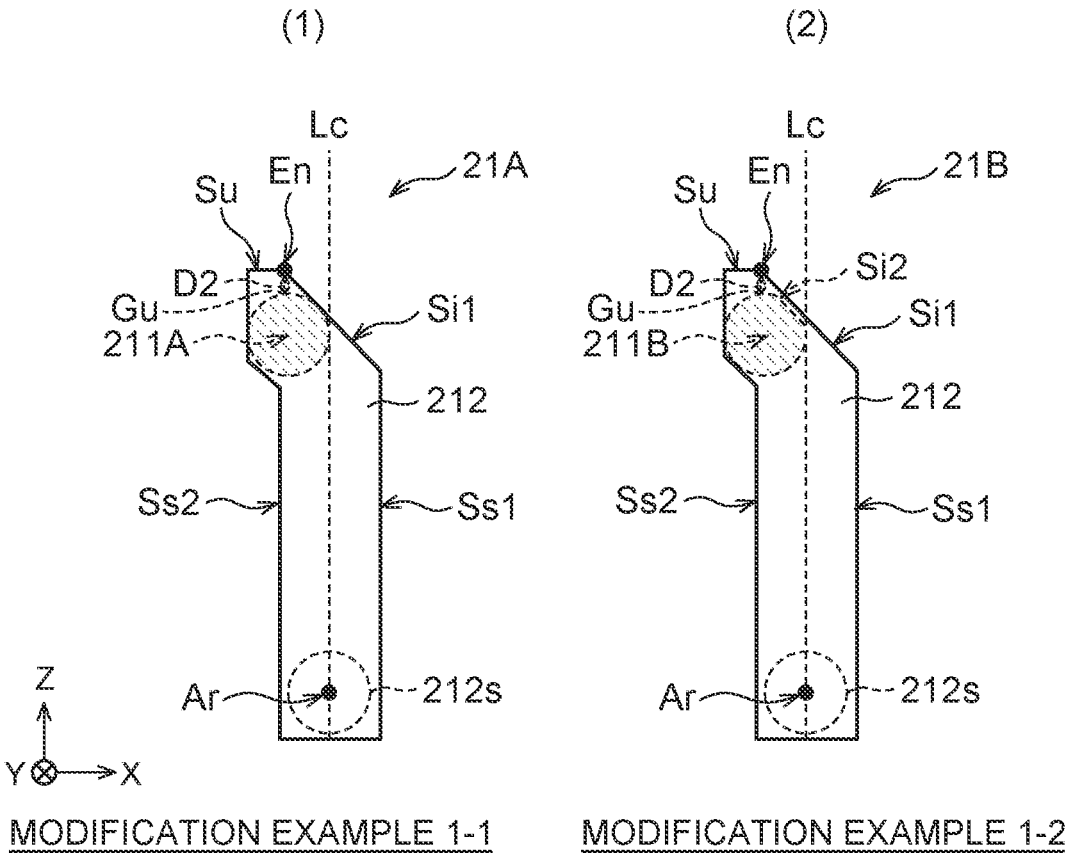
FIG. 12 is a schematic view illustrating an exemplary configuration of the handle according to a modification example 1 (modification examples 1-1 and 1-2).

FIG. 12 is a schematic Z-X side surface view illustrating a configuration example of the handle according to a modification example 1 (modification examples 1-1 and 1-2). Specifically, FIG. 12(1) and FIG. 12(2) illustrate configuration examples of the handles (a handle 21A and a handle 21B) according to modification examples 1-1 and 1-2, respectively.

Modification Example 1-1

First, in the handle 21A of the modification example 1-1 illustrated in FIG. 12(1), the two arms 212 have the same shapes as the exemplary embodiment, but a grip portion 211A having the following shape is provided instead of the grip portion 211 described in the exemplary embodiment. The upper surface portion (grip upper surface portion) Gu of the grip portion 211A is not on the same plane as the upper surface portions Su of the two arms 212 (not a position aligned with the upper surface portion Su in the Z-axis direction), and is separated by a separation distance D2 from the upper surface portion Su of the arms 212 toward a direction of the rotational axis Ar.

With a configuration of the grip portion 211A described above, the handle 21A of this modification example is as follows. That is, the grip portion 211A does not come into contact with the floor surface Sf before the arms 212 (the arms 212 comes into contact with the floor surface Sf before the grip portion 211A), and therefore it is more likely to cause the handle 21A to fall by using the shape of the arms 212 (the inclined surface Si1, and the like) described in the exemplary embodiment. As a result, it is possible to further improve reliability in this modification example. Further, the grip portion 211A does not come into contact with the floor surface Sf before the arms 212, and therefore it is also possible to make the grip portion 211A less susceptible to scratching.

Modification Example 1-2

On the other hand, the handle 21B of the modification example 1-2 illustrated in FIG. 12(2) corresponds to one provided a grip portion 211B having the following shape the instead of the grip portion 211A in the handle 21A of the modification example 1-1 described above. For each arm 212, in the grip portion 211B, like the grip portion 211A, the upper surface portion Gu is separated from the upper surface portion Su by the separation distance D2, and the following inclined surface Si2 is further provided. Specifically, the inclined surface Si2 of the grip portion 211B is inclined so as to be substantially parallel (parallel) with the inclined surface Si1 of each of the arms 212 described in the exemplary embodiment.

With a configuration of the grip portion 211B described above, the handle 21B of this modification example is as follows. That is, for example, in a case where the floor surface Sf is not a flat surface, even in a case where the grip portion 211B comes into contact with the floor surface Sf before the arms 212, it is possible to cause the handle 21B to fall by using the inclined surface Si2 of the grip portion 211B instead of the inclined surface Si1 of the arms 212. Thus, in this modification example, for example, even in the case where the floor surface Sf is not the flat surface, it is possible to take similar measures as in the exemplary embodiment and further improve reliability. Further, in this modification example, as in the above described modification example 1-1, the grip portion 211B does not come into contact with the floor surface Sf before the arms 212, and therefore it is also possible to cause the grip portion 211B less susceptible to scratching.

Modification Example 2

Figure 13:
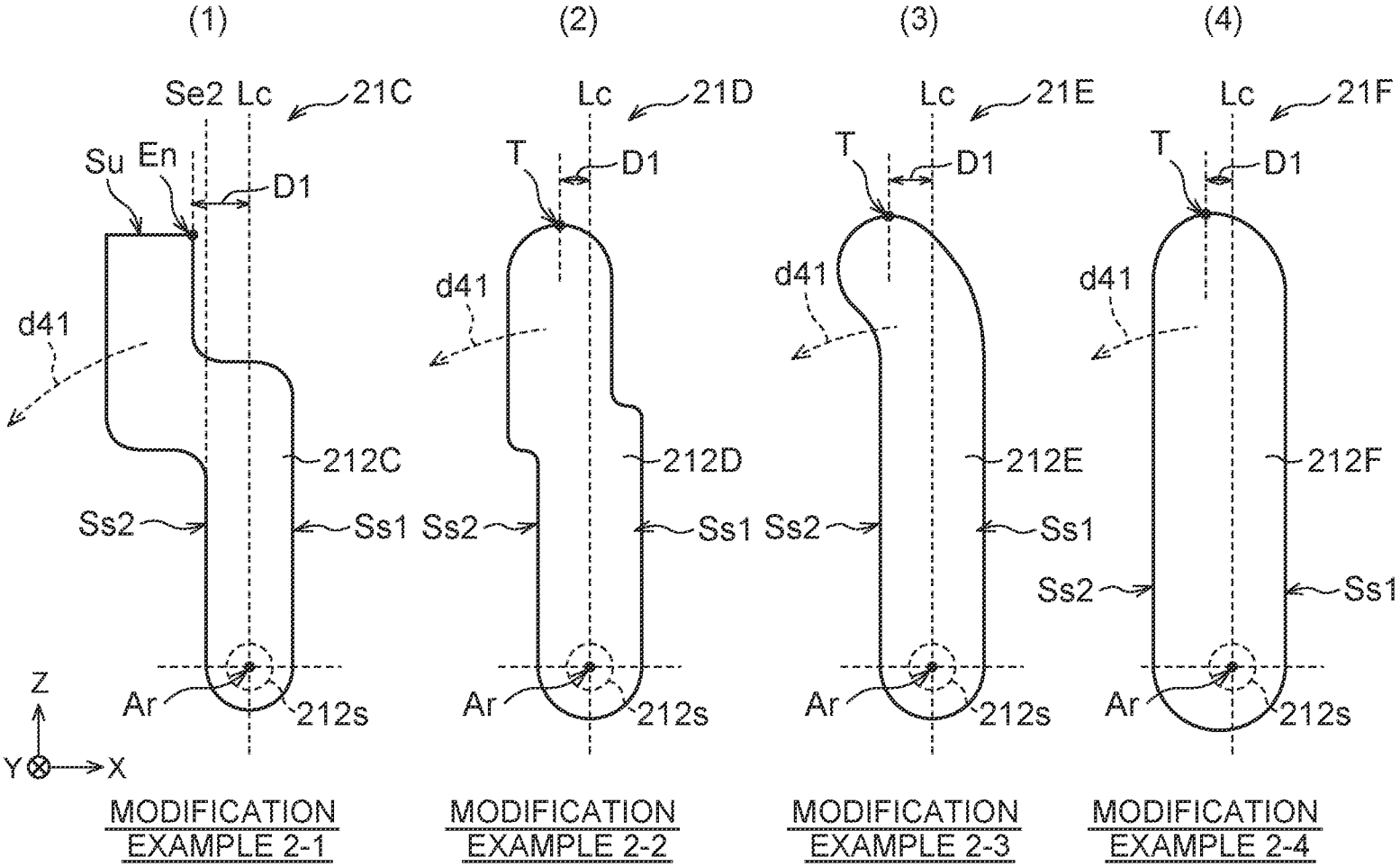
FIG. 13 is a schematic view illustrating an exemplary configuration of the handle according to a modification example 2 (modification examples 2-1 to 2-4).

FIG. 13 is a schematic Z-X side surface view illustrating a configuration example of a handle according to a modification example 2 (modification examples 2-1 to 2-4). Specifically, FIG. 13(1), FIG. 13(2), FIG. 13(3), and FIG. 13(4) respectively illustrate configuration examples of the handles (handle 21C, handle 21D, handle 21E, and handle 21F) according to a modification example 2-1, a modification example 2-2, a modification example 2-3, and a modification example 2-4.

First, as illustrated in FIG. 13(1) to FIG. 13(4), the handles 21C, 21D, 21E and 21F of these modification examples 2-1 to 2-4 are configured as follows, unlike the handles 21, 21A and 21B described in the exemplary embodiment and the modification examples 1-1 and 1-2. That is, each arm of pairs of arms 212C, 212D, 212E and 212F in the handles 21C, 21D, 21E and 21F does not include the inclined surface Si1, unlike the arms 212 of the handles 21, 21A, 21B.

However, in the handle 21C of the modification example 2-1 illustrated in FIG. 13(1), the upper surface portion Su is provided in each of the two arms 212C, like the arms 212 in the handles 21, 21A and 21B. In each of the two arms 212C, unlike the pair of arms 212, the end portion En of the upper surface portion Su is positioned to separate toward the direction d41 side from the extended surface Se2 (see separation distance D1) instead of on the surface of the extended surface Se2 from the side surface Ss2 in the arms 212C. As described in the exemplary embodiment and the modification examples 1-1 and 1-2, the arms 212 provided with the inclined surface Si1 may also be configured so that the end portion En of the upper surface portion Su is separated toward the direction d41 side from the extended surface Se2 as in this modification example.

On the other hand, in the handles 21D, 21E, and 21F of the modification examples 2-2, 2-3, and 2-4 illustrated in FIG. 13(2), FIG. 13(3), and FIG. 13(4), the arms of each of the pairs of arms 212D, 212E, and 212F include a top portion (arm top portion) T instead of the upper surface portion Su, unlike the arms 212 and 212C. That is, the upper portion side of each of the arms 212D, 212E, and 212F is a non-flat surface having the top portion T, instead of the upper surface portion Su as the flat surface.

As illustrated in FIG. 13(2), FIG. 13(3), and FIG. 13(4), in each arm of the pairs of arms 212D, 212E, 212F, the top portion T is separated toward the direction d41 side with respect to the arm center line Lc (see, the separation distance D1). In other words, the top portion T is separated from the arm center line Lc by the separation distance D1 instead of the end portion En of the upper surface portion Su.

Basically, in this modification example (modification examples 2-1 to 2-4) of such a configuration, it is possible to obtain the same effect by the same action as the exemplary embodiment, the modification examples 1-1 and 1-2. That is, in the pairs of arms 212C, 212D, 212E, and 212F of the modification examples 2-1 to 2-4, the handles 212C, 21D, 21E, and 21F easily fall toward the direction d41 side, like in the case of the pair of arms 212. Thus, it is also possible to improve reliability in this modification example.

Modification Example 3

Figure 14:
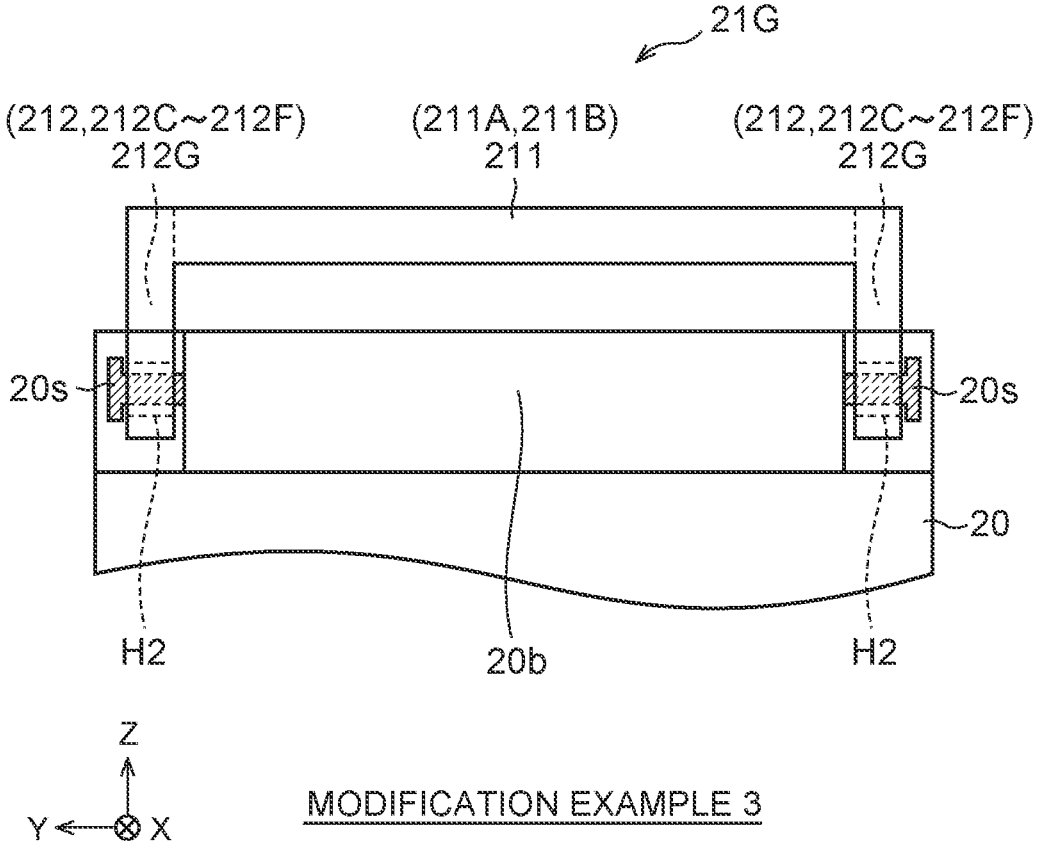
FIG. 14 is a schematic view illustrating an exemplary general configuration of the handle according to a modification example 3.

FIG. 14 is a schematic Y-Z side surface view illustrating a general configuration example of a handle (a handle 21G) according to a modification example 3. In this modification example, a configuration different from the fitting structure described above will be described regarding the fitting structure between the handle 21G in the rotational axis Ar and the storage unit 20.

Specifically, in the handle 21G of this modification example, each arm of a pair of arms 212G is formed with a fitting hole (mating hole) H2 around the rotational axis Ar. Further, a pair of handle fulcrum portions (projecting portions) 20*s* penetrating these fitting holes H2 is provided with the handle attachment portion 20*b* of the storage unit 20. Then, each of the handle fulcrum portions 20*s* is fitted into each of the fitting holes H2, and therefore each arm of the pair of arms 212G is attached to the handle attachment portion 20*b*.

In other words, in the fitting structure described above, the two fitting holes H1 are formed in the handle attachment portion 20*a* of the storage unit 20, and each arm of the pair of arms 212 is provided with the handle fulcrum portion 212*s*. On the other hand, in the fitting structure of this modification example, on the contrary, the handle attachment portion 20*b* of the storage unit 20 is provided with the pair of handle fulcrum portions 20*s*, and the fitting hole H2 is formed in each arm of the pair of arms 212G.

As illustrated in FIG. 14, either the grip portion 211A or the grip portion 211B may be provided instead of the grip portion 211 in the handle 21G of this modification example. Moreover, the shape of each arm of the pair of arms 212G is any one of the shapes of the arms 212, 212C, 212D, 212E, and 212F except that the fitting hole H2 described above is provided.

Basically, in this modification example of such a configuration, it is possible to obtain the same effect by the same action as the exemplary embodiment, the modification example 1 and the modification example 2.

3. Other Modification Examples

The present disclosure has been described above with reference to the exemplary embodiment and the modification examples thereof. However, the present disclosure is not limited to the exemplary embodiment and the modification examples described above and is modifiable in various ways.

For example, in the exemplary embodiment and the modification examples described above, the configuration (the shape, the arrangement, the number, and the like) of each of the members provided in the medium processing device (banknote pay-in/pay-out device 1) and the medium storage box (banknote storage box 2) have been specifically described. However, the configurations of the respective members are not limited to those described in the exemplary embodiment and the modification examples described above, and other shapes, arrangements, numbers, and the like may be employed.

Specifically, for example, shapes, arrangements, numbers, and the like of the storage unit 20 or the rotation restricting unit (stopper 22) are not limited to those described in the exemplary embodiment and the modification examples described above, and other shapes, arrangements, numbers, and the like may be employed.

Moreover, shapes, arrangements, numbers, and the like of the handle (grip portion and arm) are not limited to those described in the exemplary embodiment and the modification examples described above, and other shapes, arrangements, numbers, and the like may be employed. More specifically, for example, in the exemplary embodiment and the modification examples described above, the handle in which a pair of arms (two arms) is arranged at both ends of the grip portion has been described. However, the number of arms is not limited to thereto, and the number of arms may be one or three or more, for example. Moreover, for example, at least one of both of the end portions of the inclined surfaces in the arms (a portion connecting the inclined surface Si1 and the upper surface portion Su, and a portion connecting the inclined surface Si1 and the side surface Ss1) may be a rounded portion (non-corner portion) rather than a corner portion (angular portion). In the case of such a rounded portion, for example, when the medium storage box 2 illustrated in FIG. 9 falls onto the floor surface, the handle more easily falls, thereby further improving reliability.

Moreover, the series of processes that have been described above in the foregoing exemplary embodiment, etc. may be performed by means of hardware (a circuit), or may be performed by means of software (a program). In the case where the series of processes are performed by means of software, the software may include a group of programs directed to executing each function by a computer. Each of the programs may be provided beforehand to the foregoing computer, or may be installed on the foregoing computer from a network, a non-transitory recording medium, etc., for example.

In addition, the above exemplary embodiment and the modification examples have been described by referring to an example in which the banknote pay-in/pay-out device that performs various transactions (pay-in transactions or pay-out transactions, etc.) related to banknotes as one specific example of "medium processing device" in the present disclosure. However, the example is not limited to thereto, and the present disclosure may also be applied to other medium other than the banknotes. That is, for example, the present disclosure may be applied to various medium processing device handling other medium such as a coin processing device that performs various processing related to coins or a medium processing device that performs various processing related to securities such as checks and gift certificates.

Moreover, various examples described above may be applied in any combination.

It should be noted that the effects described in the present specification are merely examples and not limited to thereto, and other effects may be provided.

The present disclosure may have the following aspects.

(1)

A medium storage box, including:

a storage unit that stores a medium;

a handle configured to rotate with respect to the storage unit around a rotational axis between a first state standing with respect to the storage unit and a second state lying with respect to the storage unit; and a rotation restricting portion that restricts rotation of the handle in a second direction that is opposite to a first direction, to the second state from the first state, wherein the handle includes:

a grip portion that extends in a parallel direction of the rotational axis, and an arm that includes an upper surface portion or a top portion and extends in an extending direction from the rotational axis toward the upper surface portion or the top portion; and the arm is configured such that an end portion of an arm center line side in the upper surface portion or the top portion is separated toward the first direction side with respect to an arm center line extending from the rotational axis to the extending direction.

(2)

The medium storage box according to aspect (1), wherein the arm further includes:

an inclined surface inclining from the end portion of the upper surface portion to the second direction side, the arm extends in the extending direction from the rotational axis toward the upper surface portion.

(3)

The medium storage box according to aspect (2), wherein the arm further includes:

a first side surface that extends in the extending direction; and a second side surface that extends in the extending direction, the first side surface and the second side surface are opposed to each other, and the inclined surface extends from the end portion of the upper surface portion to a position beyond the arm center line toward the first side surface.

(4)

The medium storage box according to aspect (3), wherein the end portion of the upper surface portion is positioned on an extended surface extending in the extending direction from the second side surface, or the end portion of the upper surface portion is positioned to separate toward the first direction side from the extended surface.

(5)

The medium storage box according to aspect (4), wherein the end portion of the upper surface portion is positioned on the extended surface.

(6)

A medium processing device, including:

a main body; and a medium storage box that is attached to and detached from the main body;

wherein the medium storage box includes:

a storage unit that stores a medium;

a handle configured to rotate with respect to the storage unit around a rotational axis between a first state standing with respect to the storage unit and a second state lying with respect to the storage unit; and a rotation restricting portion that restricts rotation of the handle in a second direction that is opposite to a first direction, to the second state from the first state, the handle includes:

a grip portion that extends in a parallel direction of the rotational axis; and an arm that includes an upper surface portion or a top portion and extends in an extending direction toward the upper surface portion or the top portion from the rotational axis, the arm is configured such that an end portion of an arm center line side in the upper surface portion or the top portion is separated toward the first direction side with respect to an arm center line extending from the rotational axis to the extending direction.

The disclosure of Japanese Patent Application No. 2017-090512 filed on Apr. 28, 2017, the entire contents which are incorporated herein by reference.

The invention claimed is:

1. A medium storage box, comprising:

a storage unit that stores a medium;

a handle configured to rotate, in opposite first and second rotational directions, with respect to the storage unit around a rotational axis between a first state standing with respect to the storage unit and a second state lying with respect to the storage unit; and a rotation restricting portion that, when the handle is in the first state, restricts rotation of the handle to only the first rotational direction, wherein the handle includes:

a grip portion that extends in a direction parallel to the rotational axis; and an arm that extends in an extending direction to connect the grip portion to the storage unit, the arm being connected to the grip portion at an end thereof, the end of the arm having an arm upper surface portion that is of a flat surface or arm top portion that is of a non-flat surface; and the end of the arm is so formed that the entire arm upper surface portion, or a topmost portion of the arm top portion, is transversely spaced from and forward of a virtual line that extends in the extending direction from the rotational axis when the handle is in the first state, with respect to the first rotational direction.

2. The medium storage box of claim 1, wherein the arm upper surface portion includes a first end portion closer to the virtual line than a second portion, and the arm further includes an inclined surface inclining from the first end portion of the arm upper surface portion to a side of the second rotational direction.

3. The medium storage box of claim 2, wherein the arm further includes:

a first side surface that extends in the extending direction; and a second side surface that extends in the extending direction, the first side surface and the second side surface are opposed to each other with respect to the virtual line, and the inclined surface extends from the first end portion of the arm upper surface portion to a position on the first side surface, the position and the first end portion being on different sides of virtual line.

4. The medium storage box of claim 3, wherein the first end portion of the arm upper surface portion is transversely spaced from and forward of a virtual extended line that extends in the extending direction from the second side surface, with respect to the first rotational direction.

5. The medium storage box of claim 3, wherein the first end portion of the arm upper surface portion is positioned on a virtual extended line that extends in the extending direction from the second side surface.

6. The medium storage box of claim 1, wherein the grip portion includes a grip upper surface portion that is on the same plane as the arm upper surface portion.

7. The medium storage box of claim 1, wherein the grip portion includes a grip upper surface portion disposed between the arm upper surface portion and the rotational axis.

8. The medium storage box of claim 1, wherein the arm is a first arm, the handle further includes a second arm and is configured so that the first arm and the second arm are connected to each other through the grip portion, and the second arm includes an arm upper surface portion or arm top portion on a side of the grip portion and extends from the rotational axis to the arm upper surface portion or arm top portion thereof.

9. A medium processing device, comprising:

a main body; and a medium storage box that is attachable to and detachable from the main body; wherein the medium storage box includes:

a storage unit that stores a medium;

a handle configured to rotate in opposite first and second rotational directions, with respect to the storage unit around a rotational axis between a first state standing with respect to the storage unit and a second state lying with respect to the storage unit; and a rotation restricting portion that, when the handle is in the first state, restricts rotation of the handle to only the first rotational direction; and the handle includes:

a grip portion that extends in a direction parallel to the rotational axis; and an arm that extends in an extending direction to connect the grip portion to the storage unit, the arm being connected to the grip portion at an end thereof, the end of the arm having an arm upper surface portion that is of a flat surface or arm top portion that is of a non-flat surface; and the end of the arm is so formed that the entire arm upper surface portion, or a topmost portion of the arm top portion, is transversely spaced from and forward of a virtual line that extends in the extending direction from the rotational axis, with respect to the first rotational direction.

* * * * *